United States Patent [19]

Riddick

[11] Patent Number: 4,949,634

[45] Date of Patent: Aug. 21, 1990

[54] PRESS APPARATUS

[75] Inventor: Ian W. Riddick, Bury, England

[73] Assignee: Beloit Corporation, Beloit, Wis.

[21] Appl. No.: 362,184

[22] Filed: Jun. 6, 1989

[30] Foreign Application Priority Data

Jun. 23, 1988 [GB] United Kingdom ..... 8815009

[51] Int. Cl.[5] ..... B30B 9/24

[52] U.S. Cl. ..... 100/118; 100/151; 100/153; 162/273

[58] Field of Search ..... 100/118, 151, 153, 154, 100/160; 162/273, 274, 360.1, 272; 34/111, 116, 117, 120, 123

[56] References Cited

U.S. PATENT DOCUMENTS

| | | | |
|---|---|---|---|
| 3,446,139 | 5/1969 | Coffelt | 100/118 |
| 3,600,273 | 8/1971 | McCarrick et al. | 162/273 |
| 4,259,143 | 3/1981 | Giulie et al. | 100/151 X |
| 4,354,934 | 10/1982 | Kohonen | 100/118 X |
| 4,450,630 | 5/1984 | Phelps | 162/273 X |
| 4,608,125 | 8/1986 | Autio | 162/273 |
| 4,657,634 | 4/1987 | Autio | 162/273 X |
| 4,826,572 | 5/1989 | Fukui et al. | 162/273 X |

*Primary Examiner*—Harvey C. Hornsby

*Assistant Examiner*—Stephen F. Gerrity

*Attorney, Agent, or Firm*—Dirk J. Veneman; Raymond W. Campbell; David J. Archer

[57] ABSTRACT

A press apparatus is disclosed for removing water from a formed web. The apparatus includes first, second and third press members and corresponding backing rolls which cooperate with the respective press members for defining therebetween first, second and third press nips. A wet end support supports the first press member and the backing roll device. A dry end frame is disposed downstream relative to the wet end support for supporting the third press member. An intermediate anchoring arrangement is disposed between the support and the frame for supporting the second press member. A plurality of pivoted links removably extend between the wet end support, dry end frame and intermediate anchoring arrangement such that in an operative mode, the support, frame and anchoring arrangement are rigidly connected together for stabilizing the press apparatus and when the press apparatus is in an inoperative mode, the links are released from and pivoted relative to the press apparatus for facilitating the removal of the press members and backing roll device from the press apparatus, and for facilitating felting of the press.

16 Claims, 3 Drawing Sheets

PRESS APPARATUS

BACKGROUND OF THE INVENTION

1. Field of the Invention

This invention relates to a press apparatus for pressing a formed web. More particularly, this invention relates to a press apparatus in which the press rolls may be removed upwardly away from the press apparatus.

2. Information Disclosure Statement

Numerous press section configurations have been proposed in an attempt to remove as much water as possible from the formed web prior to the web extending through a drying section of a papermaking machine.

Among the more successful press configurations are the so-called "TRI-NIP" and "TriVent" press arrangements. TRI-NIP is a Registered Trademark of Beloit Corporation and TriVent is a common law trademark of Beloit Corporation.

In the TRI-NIP arrangement, a first press member cooperates with a backing roll to define a first press nip. A second press roll which is a granite roll cooperates with the backing roll to define a downstream second press nip. A third press roll is disposed downstream relative to the backing roll and cooperates with the granite roll for defining a third press nip.

In the construction of the aforementioned TRI-NIP press, the first press roll and backing roll are rotatably supported by a wet end support. The third press roll is rotatably supported by a dry end frame which is not directly connected to the wet end support. The granite roll is independently and rigidly supported for rotation by an intermediate anchoring arrangement such that, to a very limited degree, the rotatable granite roll floats between the wet end support and the dry end frame.

Due to the ever increasing rotational speeds encountered in press sections of the aforementioned TRI-NIP arrangement, and because of the considerable means of the rolls rotating within the press apparatus, there exists a strong tendency for vibration to be generated between the wet end support, the dry end frame and the intermediate anchoring means.

In order to increase the natural frequency of vibration between the aforementioned supports and thereby stabilize the press apparatus, various ties between the support, frame and anchoring arrangement means have been proposed.

However, in the so-called "Open Top" configuration as exemplified in the TRI-NIP press, much time has been expended in disconnecting the aforementioned ties when roll removal, or felt changing, was required.

Similarly, in the aforementioned TriVent press arrangement, the first backing roll is followed by a second downstream backing roll for defining a second press nip between the second backing roll and the granite roll.

In both the TRI-NIP and the TriVent configurations, improved removal of the press rolls away from the press apparatus is desirable.

When the aforementioned ties were used, the ties were unbolted at both ends and the ties were removed from the press apparatus in order to gain access to the press rolls for removal of the press rolls. The ties are relatively heavy and much time has been involved in removing several of the ties when replacing a press roll or replacing a press felt.

The present invention seeks to overcome the aforementioned problems by providing pivoted links which can be unbolted at one end and pivoted horizontally away from the press apparatus so that access to the press apparatus is facilitated. When the links are pivoted away from the press apparatus, such links are fully supported at the pivotal end thereof and when such links are bolted between the respective wet end supports, dry end frame and intermediate anchoring means, the press apparatus is stabilized thereby increasing the natural frequency of vibration of the press apparatus so that the press apparatus runs smoothly.

Therefore, it is a primary objective of the present invention to overcome the aforementioned inadequacies of the prior art proposals and to provide a press apparatus which contributes a significant improvement to the paper web pressing art.

Another object of the present invention is the provision of a press apparatus in which a wet end support means supports a first press member and a backing roll means and a dry end frame means is disposed downstream relative to the wet end support means for supporting a third press member. An intermediate anchoring means is disposed between the support means and the frame means for supporting a second press member. Pivoted link means removably extend between the support means, the frame means and the intermediate anchoring means for stabilizing the press apparatus.

Another object of the present invention is the provision of a press apparatus in which the link means removably extend between the support means, the frame means and the intermediate anchoring means such that in an operative mode of the press apparatus, the support means, frame means and anchoring means are rigidly connected together for stabilizing the press apparatus and so that in an inoperative mode of the press apparatus, the link means are released from, and pivoted relative to the press apparatus for facilitating removal of the press members and backing roll means for the press apparatus.

Another object of the present invention is the provision of a press apparatus in which the pivoted link means are disposed horizontally and pivot horizontally relative to the press apparatus.

Another object of the present invention is the provision of a link means which includes a first linking means removably extending between the wet end support means and the dry end frame means such that in the inoperative mode, the first linking means pivots relative to the press apparatus. A first link removably extends between the wet end support means and the intermediate anchoring means such that in the inoperative mode, the first link is pivoted relative to the press apparatus.

Another object of the present invention is the provision of a press apparatus in which a second link removably extends between the intermediate anchoring means and the dry end frame means such that in the inoperative mode, the second link is pivoted relative to the press apparatus.

Another object of the present invention is the provision of a press apparatus in which the wet end support means includes a first section for rotatably supporting the first press member and the backing roll means and a second section connected to, and supported by, the first section with the first linking means including a third link extending between the dry end frame means and the second section and a fourth link removably extending between the first section and the second section.

Another object of the present invention is the provision of a press apparatus in which the third link is disposed on the opposite side of the press apparatus relative to the first, second and fourth links.

Another object of the present invention is the provision of a press apparatus in which the link means include a plurality of removable links extending between the support means, the frame means and the anchoring means with each link of the plurality of links having a first and a second end. The first end includes a first portion and a first anchor plate pivotally connected to the first portion and fastening means for removably fastening the first anchor plate relative to the first portion such that when the fastening means is unfastened, the link is permitted to pivot relative to the first anchor plate.

Another object of the present invention is the provision of a press apparatus in which the fastening means includes a first plurality of swing bolts pivotally anchored relative to the first anchor plate, the swing bolts cooperating with corresponding anchoring slots defined by the first portion such that in the inoperative mode, the swing bolts are loosened such that the bolts pivot from the anchoring slots thereby enabling the link to pivot away from the first anchor plate.

Another object of the present invention is the provision of a press apparatus in which the second end of the link includes a second portion and a second anchor plate. A second plurality of swing bolts are pivotally connected to the second anchor plate such that the second plurality of swing bolts cooperate with corresponding closed channels defined by the second portion. The arrangement is such that in the operative mode, the second plurality of swing bolts are tightened for rigidly connecting together the second portion and the second anchor plate and when the press apparatus is in an inoperative mode, the second plurality of swing bolts are unfastened and pivoted away from the second portion such that the link is permitted to pivot relative to the press apparatus.

Another object of the present invention is the provision of a press apparatus in which the second portion moves away from the second anchor plate and outwardly away from the press apparatus in the inoperative mode.

Another object of the present invention is the provision of a press apparatus in which the second portion moves away from the second anchor plate and inwardly relative to the press apparatus such that the link pivots into the press apparatus in the inoperative mode thereof.

Another object of the present invention is the provision of a method of operating a press apparatus which enables the unfastening of the first end and then the second end of one or more links such that the links are pivoted relative to the press apparatus so that access to the press rolls for removal thereof is facilitated and changing of a press felt is simplified.

Other objects and advantages of the present invention will be apparent to those skilled in the art by a consideration of the detailed description contained hereinafter taken in conjunction with the annexed drawings.

SUMMARY OF THE INVENTION

The present invention relates to a press apparatus and method for removing water from a formed web. The apparatus includes a first press member and a backing roll means cooperating with the first press member for defining therebetween a first press nip such that when the web extends through the first press nip, a first portion of water is removed from the web. A second press member is disposed downstream relative to the first press nip with the second press member cooperating with the roll means for defining therebetween a second a press nip such that when the web extends through the second press nip, a second portion of water is removed from the web. A third press member is disposed downstream relative to the second press nip, with the third press member cooperating with the second press member for defining therebetween a third press nip such that when the web extends through the third press nip, a third portion of water is removed from the web. A wet end support means supports the first press member and the backing roll means and a dry end frame means is disposed downstream relative to the wet end support means for supporting the third press member. An intermediate anchoring means is disposed between the support means and the frame means for supporting the second press member. A pivoted link means removably extends between the support means, the frame means and the intermediate anchoring means such that in an operative mode of the press apparatus, the support means, frame means and the anchoring means are rigidly connected together for stabilizing the press apparatus and so that in an inoperative mode of the press apparatus, the link means are released from, and pivoted relative to, the press apparatus for facilitating the removal of the press members and backing roll means from the press apparatus.

In a more specific embodiments of the present invention, the first press member is a press roll rotatably supported by the wet end support means and the backing roll means is a first backing roll which is rotatably and adjustably supported by the wet end support means.

In a second embodiment of the present invention, the backing roll means includes a first backing roll rotatably and adjustably supported relative to the wet end support means and a second backing roll disposed downstream relative to the first backing roll with the second backing roll being rotatably and adjustably supported relative to the wet end support means.

In both embodiments of the present invention, the second press member is a second press roll rotatably supported by the intermediate anchoring means.

In the second embodiment of the present invention, the second press member cooperates with the second backing roll for defining the second press nip therebetween.

In both embodiments of the present invention, the third press member is a third press roll which is rotatably and adjustably supported relative to the dry end frame means.

In both embodiments of the present invention, the link means includes a first linking means removably extending between the wet end support means and the dry end frame means such that in an inoperative mode, the first linking means pivots relative to the press apparatus. Also, a first link removably extends between the wet end support means and the intermediate anchoring means such that in the inoperative mode, the first link is pivoted relative to the press apparatus.

A second link removably extends between the intermediate anchoring means and the dry end frame means such that in the inoperative mode, the second link is pivoted relative to the press apparatus.

In the second embodiment of the present invention, the wet end support means includes a first section for rotatably supporting the first press member and the backing roll means and a second section connected to, and supported by, the first section. The first linking means includes a third link removably extending between the dry end frame means and the second section such that in the inoperative mode, the third link is pivoted relative to the press apparatus. A fourth link removably extends between the first section and the second section such that in the inoperative mode, the fourth link is pivoted relative to the press apparatus.

In the second embodiment of the present invention, the third link is disposed on the opposite side of the press apparatus relative to the first, second and fourth links.

In both embodiments of the present invention, the link means include a plurality of removable links extending between the support means, the frame means and the anchoring means. Each link of the plurality of links has a first and a second end. The first end includes a first portion, a first anchor plate pivotally connected to the first portion and fastening means for removably fastening the first anchor plate relative to the first portion such that when the fastening means is unfastened, the link is permitted to pivot relative to the first anchor plate.

In both embodiments of the present invention, the fastening means include a first plurality of swing bolts pivotally anchored to the first anchor plate, the first plurality of swing bolts cooperating with corresponding anchoring slots defined by the first portion such that in the inoperative mode, the swing bolts are loosened such that the bolts pivot away from the anchoring slots thereby enabling the link to pivot away from the first anchor plate.

In both embodiments of the present invention, the second end of the link includes a second portion and a second anchor plate. A second plurality of swing bolts are pivotally connected to the second anchor plate such that the second plurality of swing bolts cooperate with corresponding closed channels defined by the second portion such that in the operative mode, the second plurality of swing bolts are tightened for rigidly connecting together the second portion and the second anchor plate. When the press apparatus is in the inoperative mode, the second plurality of swing bolts are unfastened and pivoted away from the second portion such that the ink is permitted to pivot relative to the press apparatus.

In both embodiments of the present invention, the second portion moves away from the second anchor plate and outwardly away from the press apparatus in the inoperative mode.

In a third embodiment of the present invention, which is applicable to both the first and second embodiments, the second portion moves away from the second anchor plate and inwardly relative to the press apparatus such that the link pivots into the press apparatus in the inoperative mode.

The present invention also includes a method for removing water from a formed web and includes unfastening the first and second ends of the links extending between a wet end support means, a dry end frame means and an intermediate anchoring means. The links are then pivoted horizontally relative to the press apparatus for facilitating removal of press rolls upwardly away from the press apparatus and for changing press felts.

Although the present invention will be described with a certain degree of particularity in the detailed description contained hereinafter, it will be appreciated by those skilled in the art that the present invention is not limited to the specific embodiments described. Rather, the present invention includes many modifications and variations which fall within the spirit and scope of the present invention as defined by the appended claims. Included in such modifications would be the provision of a fourth press nip and press arrangements which include one or more extended nip presses.

BRIEF DESCRIPTION OF THE DRAWINGS

Similar reference characters refer to similar parts throughout the various embodiments of the present invention.

DETAILED DESCRIPTION OF THE DRAWINGS

Figure 1:
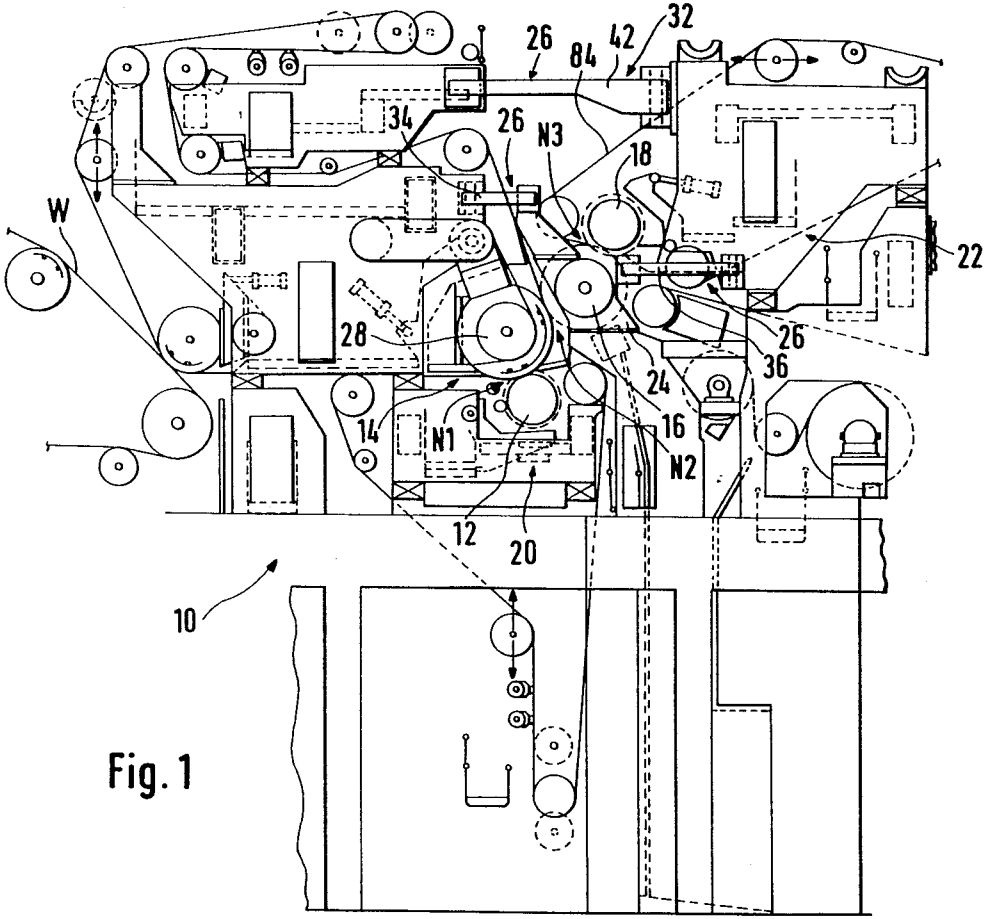
FIG. 1 is a side-elevational view of a TRI-NIP press having horizontally extending links according to the present invention.

FIG. 1 is a side-elevational view of a press apparatus generally designated 10 for removing water from a formed web W. The apparatus 10 includes a first press member 12 and a backing roll means generally designated 14 which cooperates with the first press member 12 for defining therebetween, a first press nip N1 such that when the web W extends through the first press nip N1 a first portion of water is removed from the web W.

A second press member 16 is disposed downstream relative to the first press nip N1 with the second press member 16 cooperating with the roll means 14 for defining therebetween a second press nip N2 such that when the web W extends through the second press nip N2 a second portion of water is removed from the web W.

A third press member 18 is disposed downstream relative to the second press nip N2 with the third press member 18 cooperating with the second press member 16 for defining therebetween a third press nip N3 such that when the web W extends through the third press nip N3, a third portion of water is removed from the web W. A wet end support means generally designated 20 supports the first press member 12 and the backing roll means 14.

A dry end frame means 22 is disposed downstream relative to the wet end support means 20 for supporting the third press member 18.

An intermediate anchoring means 24 is disposed between the support means 20 and the frame means 22 for supporting the second press member 16.

Pivoted link means generally designated 26 removably extend between the support means 20, the frame means 22 and the intermediate anchoring means 24 such that in an operative mode of the press apparatus 10, the support means 20, the frame means 22 and the anchoring means 24 are rigidly connected together for stabilizing the press apparatus 10 and so that in an inoperative mode of the press apparatus 10, the link means 26 are released from, and pivoted relative to, the press apparatus 10 for facilitating the removal of the press members 12, 16 and 18 and backing roll means 14 from the press apparatus 10.

As shown in FIG. 1, the link means 26 includes a linking means generally designated 32 and first link 34 extending between the wet end support means 20 and the intermediate anchoring means 24. The link means 26 also includes a second link 36 which extends between the frame means 22 and the anchoring means 24. Additionally, the linking means 32 includes a third link 42 which extends between the wet end support means 20 and the dry end frame means 22.

As shown in FIG. 1, the first press member 12 is a press roll which is rotatably supported by the wet end support means 20. Further, the backing roll means 14 is a first backing roll 28 rotatably and adjustably supported by the wet end support means 20.

Figure 2:
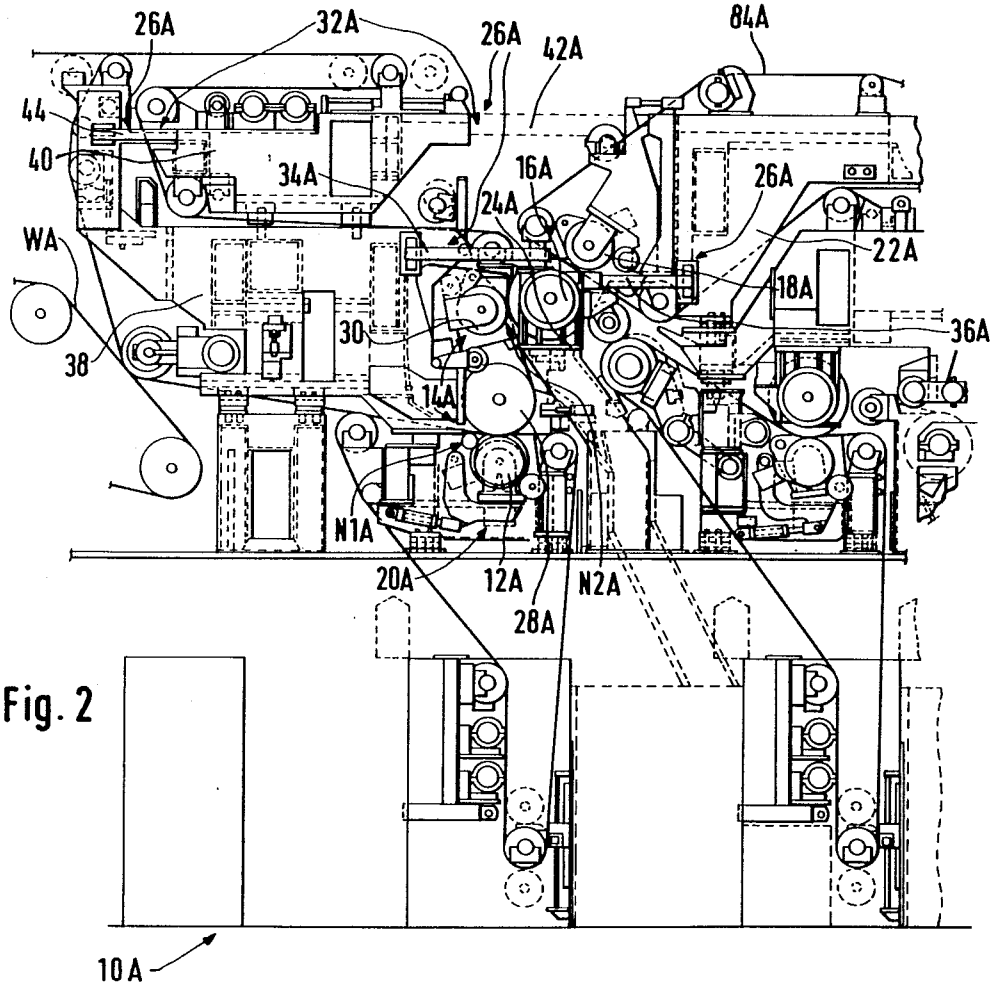
FIG. 2 is a side-elevational view of a second embodiment of the present invention and shows a TriVent press section having horizontally extending links.

FIG. 2 shows a second embodiment of the present invention in which a press apparatus generally designated 10A is a TriVent press. The apparatus 10A includes a first backing roll means generally designated 14A which includes a first backing roll 28A rotatably and adjustably supported relative to the wet end support means generally designated 20A and a second backing roll 30 disposed downstream relative to the first backing roll 28A with the second backing roll 30 being rotatable and adjustably supported relative to the wet end support means 20A.

In the embodiment shown in FIG. 2, the second press member is a second press roll 16A which may be a granite roll rotatably supported by an intermediate anchoring means 24A. The second press member 16A cooperates with the second backing roll 30 as shown in FIG. 2 for defining the second press nip N2A therebetween.

In the second embodiment of the present invention as shown in FIG. 2, the third press member 18A is a third press roll rotatably and adjustably supported relative to the dry end frame means 22A.

In the embodiment shown in FIG. 2, the link means generally designated 26A includes a first linking means generally designated 32A removably extending between the wet end support means 20A and the dry end frame means 22A such that in the inoperative mode, the first linking means 32 pivots relative to the press apparatus 10A.

As shown in FIG. 2, a first link 34A removably extends between the wet end support means 20A and the intermediate anchoring means 24A such that in the inoperative mode, the first link 34A pivots relative to the press apparatus 10A.

A second link 36A removably extends between the intermediate anchoring means 24A and the dry end frame means 22A such that in the inoperative mode, the second link 36A is pivoted relative to the press apparatus 10A.

In the embodiment shown in FIG. 2, the wet end support means 20A includes a first section 38 for rotatably supporting the first press member 12A and the backing roll means 14A. A second section 40 is connected to, and supported by, the first section 38.

The first linking means 32A, shown in FIG. 2, includes a third link 42A removably extending between the dry end frame means 22A and the second section 40 such that in the inoperative mode, the third link 42A is pivoted relative to the press apparatus 10A. Alternatively, the link 42A can be fixed and non-pivoting.

The linking means 32A also includes a fourth link 44 removably extending between the first section 38 and the second section 40 such that in the inoperative mode, the fourth link 44 is pivoted relative to the press apparatus 10A.

In the second embodiment of the present invention as shown in FIG. 2, the third link 42A is disposed on the opposite side of the press apparatus 10A relative to the first, second and fourth links 34A, 36A and 44 respectively.

In both embodiments of the present invention as shown in FIG. 1 and 2, the link means 26 and 26A respectively, include a plurality of removable links extending between the support means, the frame means and the anchoring means.

Each link of the plurality of links, 34, 36, 42 and 34A, 36A, 42A and 44, has a first and a second end.

Figure 3:
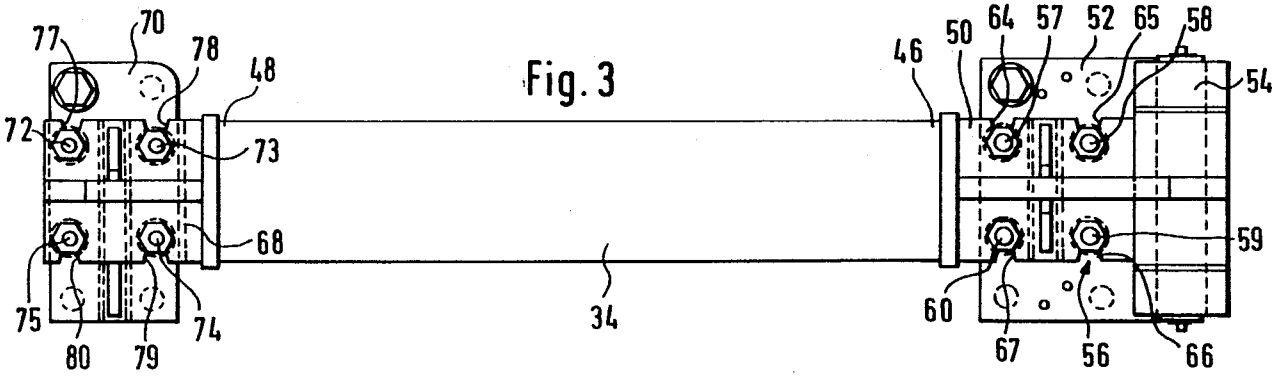
FIG. 3 is an enlarged side-elevational view of one of the pivoted links according to the present invention.

FIG. 3 is an enlarged elevational view of the link 34 and is typical of the other links 36, 42, 34A, 36A, 42A, and 44. As shown in FIG. 3, the link 34 includes a first and second end 46 and 48 respectively. The first end 46 and the link 34 includes a first portion 50 and a first anchor plate 52 pivotally connected to the first portion 50 by a pivot pin 54. Fastening means generally designated 56 removably fasten the first anchor plate 52 relative to the first portion 50 such that when the fastening means 56 is unfastened, the link 34 is permitted to pivot relative to the first anchor plate 52.

Figure 4:
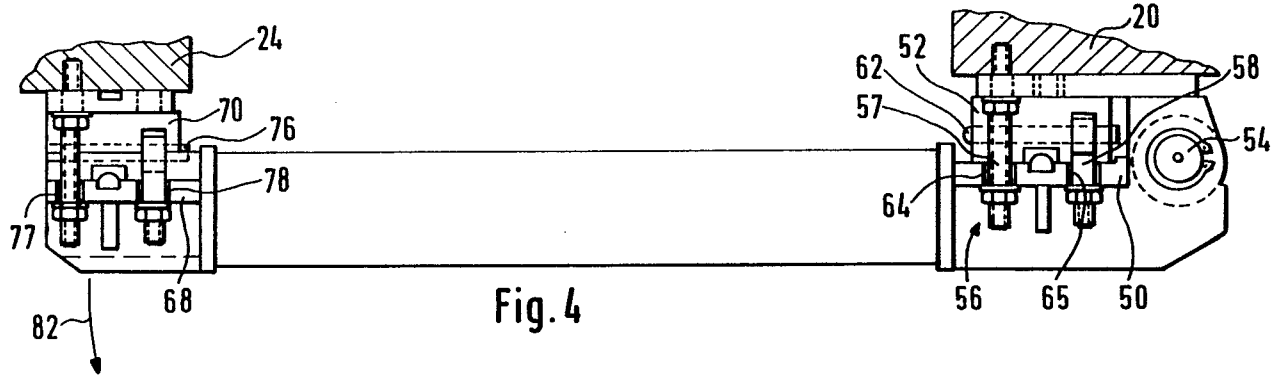
FIG. 4 is a top plan view of the link shown in FIG. 3.

FIG. 4 is a top plan view of the link 34 and shows the fastening means generally designated 56. The fastening means 56 as shown in FIGS. 3 and 4 includes a first plurality of swing bolts 57, 58, 59 and 60 pivotally anchored by a first rod 62 relative to the first anchor plate 52. The first plurality of swing bolts 57–60 cooperate with corresponding anchoring slots 64, 65, 66 and 67 defined by the first portion 50 such that in the inoperative mode, the swing bolts 57 to 60 are loosened such that the bolts 57 to 60 pivot away from anchoring slots 64 to 67 thereby enabling the link 34 to pivot away from the first anchor plate 52.

As shown in FIGS. 3 and 4, the second end 48 of the link 34 includes a second portion 68 and a second anchor plate 70. A second plurality of swing bolts 72, 73 74 and 75 are pivotally connected by a second rod 76 to the second anchor plate 70 as shown in FIG. 4, such that the second plurality of swing bolts 72 to 75 cooperate with corresponding closed channels 77, 78, 79 and 80 defined by the second portion 68. The arrangement is such that in the operative mode, the second plurality of swing bolts 72 to 75 are tightened for rigidly connecting together the second portion 68 and the second anchor plate 70. When the press apparatus 10 is in the inoperative mode, the second plurality of swing bolts 72 to 75 are unfastened and pivoted about rod 76 away from the secod portion 68 such that the link 34 is permitted to pivot about pivot pin 54 relative to the press apparatus 10.

As shown in FIG. 4, the second portion 68 moves away from the second anchor plate 70 and outwardly away from the press apparatus 10, and more particularly, the intermediate anchoring means 24, in the inoperative mode as indicated by the arrow 82.

Alternately, the second portion 68 moves away from the second anchor plate 70 and inwardly relative to the press apparatus 10 such that the link 34 pivots into the press apparatus 10 in the inoperative mode. This particular embodiment has the advantage that when space is limited at the side of the press apparatus 10, the link 34 can be swung inwardly within the press apparatus 10 so that access may be gained to the press rolls 12, 16 and 18 for their removal and replacement of press felts.

In operation of the press apparatus according to the present invention, when the press apparatus is in an operative mode, the swing bolts 57 to 60 and 72 to 75 of the link 34 and all the other links are tightened so that the links rigidly connect the various framing components such as the wet end support, the dry end frame and the intermediate anchoring means together. The arrangement is such that the press apparatus is stabilized and strengthened and vibration of the various press rolls is minimized.

In the inoperative mode, the swing bolts 57 to 60 are unbolted and then the swing bolts 72 to 75 are released and swung outwardly away from the slots 64–67 and closed channels 77 to 80 respectively. The link 34 is then pivoted either away from the press apparatus as shown in FIGS. 1–4 or inwardly, within the press apparatus.

In either case, the link 34 which is relatively massive is supported and pivots about pin 54 relative to the first anchor plate 52 and does not have to be removed or lowered to the floor.

With the link 34 swung either outwardly through 90 degrees or 180 degrees from the operative disposition thereof, access to the various press rolls and backing rolls is facilitated.

Additionally, when the various links are released and pivoted relative to the press apparatus, one or more of the press felts 84, 84A can be removed laterally from the press apparatus.

The present invention provides a simple means for rigidly connecting together various framing supports in a press apparatus so that the press rolls are stabilized and so that vibration is minimized. Additionally, the present invention avoids the need for a hoist or the like for lowering various ties from the press apparatus to the floor. Also, the present invention enables easy access to the various press rolls for removal and replacement thereof and facilitates changing of the press felts.

What is claimed is:

1. A press apparatus for removing water from a formed web, said apparatus comprising:

a first press member;

backing roll means cooperating with said first press member for defining therebetween a first press nip such that when the web extends through said first press nip, a first portion of water is removed from the web;

a second press member disposed downstream relative to said first press nip, said second press member cooperating with said roll means for defining therebetween a second press nip such that when the web extends through said second press nip, a second portion of water is removed from the web;

a third press member disposed downstream relative to said second press nip, said third press member cooperating with said second press member for defining therebetween a third press nip such that when the web extends through said third press nip, a third portion of water is removed from the web;

a wet end support means for supporting said first press member and said backing roll means;

dry end frame means disposed downstream relative to said wet end support means for supporting said third press member;

intermediate anchoring means disposed between said support means and said frame means for supporting said second press member; and pivoted link means removably extending between said support means, said frame means and said intermediate anchoring means such that in an operative mode of the press apparatus, said support means, frame means and anchoring means are rigidly connected together for stabilizing the press apparatus and so that in an inoperative mode of the press apparatus, said link means are released from and pivoted relative to the press apparatus for facilitating the removal of said press members and backing roll means from the press apparatus.

2. A press apparatus as set forth in claim 1 wherein said first press member is a press roll rotatably supported by said wet end support means.

3. A press apparatus as set forth in claim 1 wherein said backing roll means is a first backing roll rotatably and adjustably supported by said wet end support means.

4. A press apparatus as set forth in claim 1 wherein said backing roll means includes:

a first backing roll rotatably and adjustably supported relative to said wet end support means;

a second backing roll disposed downstream relative to said first backing roll, said second backing roll being rotatably and adjustably supported relative to said wet end support means.

5. A press apparatus as set forth in claim 4 wherein said second press member cooperates with said second backing roll for defining said second press nip therebetween.

6. A press apparatus as set forth in claim 1 wherin said second press member is a second press roll rotatably supported by said intermediate anchoring means.

7. A press apparatus as set forth in claim 1 wherein said third press member is a third press roll rotatably and adjustably supported relative to said dry end frame means.

8. A press apparatus as set forth in claim 1 wherein said link means includes:

a first linking means removably extending between said wet end support means and said dry end frame means such that in said inoperative mode, said first linking means pivots relative to the press apparatus;

a first link removably extending between said wet end support means and said intermediate anchoring means such that in said inoperative mode, said first link is pivoted relative to the press apparatus;

a second link removably extending between said intermediate anchoring means and said dry end frame means such that in said inoperative mode, said second link is pivoted relative to the press apparatus.

9. A press apparatus as set forth in claim 8 wherein said wet end support means includes:

a first section for rotatably supporting said first press member and said backing roll means;

a second section connected to, and supported by, said first section;

said first linking means including:

a third link removably extending between said dry end frame means and said second section such that in said inoperative mode, said third link is pivoted relative to the press apparatus;

a fourth link removably extending between said first section and said second section such that in said inoperative mode, said fourth link is pivoted relative to the press apparatus.

10. A press apparatus as set forth in claim 9 wherein said third link is disposed on the opposite side of the press apparatus relative to said first, second and fourth links.

11. A press apparatus as set forth in claim 1 wherein said link means includes:

a plurality of removable links extending between said support means, said frame means and said anchoring means, each link of said plurality of links having a first and a second end;

said first end including:

a first portion;

a first anchor plate pivotally connected to said first portion;

fastening means for removably fastening said first anchor plate relative to said first portion such that when said fastening means is unfastened in said inoperative mode, said link is permitted to pivot relative to said first anchor plate.

12. A press apparatus as set forth in claim 11 wherein said fastening means includes a first plurality of swing bolts pivotally anchored relative to said first anchor plate, said first plurality of swing bolts cooperating with corresponding anchoring slots defined by said first portion such that in said inoperative mode, said swing bolts are loosened such that said bolts pivot away from said anchoring slots thereby enabling said link to pivot away from said first anchor plate.

13. A press apparatus as set forth in claim 11 wherein said second end of said link includes:

a second portion:

a second anchor plate;

a second plurality of swing bolts pivotally connected to said second anchor plate such that said second plurality of swing bolts cooperate with corresponding closed channels defined by said second portion such that in said operative mode, said second plurality of swing bolts are tightened for rigidly connecting together said second portion and said second anchor plate and when the press apparatus is in said inoperative mode, said second plurality of swing bolts are unfastened and pivoted away from said second portion such that said link is permitted to pivot relative to said press apparatus.

14. A press apparatus as set forth in claim 13 wherein said second portion moves away from said second anchor plate and outwardly away from said press apparatus in said inoperative mode.

15. A press apparatus as set forth in claim 13 wherein said second portion moves away from said second anchor plate and inwardly relative to the press apparatus such that the link pivots into the press apparatus in said inoperative mode.

16. A press apparatus for removing water from a formed web, said apparatus comprising:

a first press member;

backing roll means cooperating with said first press member for defining therebetween a first press nip such that when the web extends through said first press nip, a first portion of water is removed from the web;

a second press member disposed downstream relative to said first press nip, said second press member cooperating with said roll means for defining therebetween a second press nip such that when the web extends through said second press nip, a second portion of water is removed from the web;

a third press member disposed downstream relative to said second press nip, said third press member cooperating with said second press member for defining therebetween a third press nip such that when the web extends through said third press nip, a third portion of water is removed from the web;

a wet end support means for supporting said first press member and said backing roll means;

dry end frame means disposed downstream relative to said wet end support means for supporting said third press member;

intermediate anchoring means disposed between said support means and said frame means for supporting said second press member;

pivoted link means removably extending horizontally between said support means, said frame means and said intermediate anchoring means such that in an operative mode of the press apparatus, said support means, frame means and anchoring means are rigidly connected together for stabilizing the press apparatus and so that in an inoperative mode of the press appartus, said link means are released from, and pivoted horizontally relative to, the press apparatus for facilitating the removal of said press members and backing roll means from the press apparatus; and said pivoted link means including:

a plurality of removable links extending between said support means said frame means and said anchoring means, each link of said plurality of links having a first and a second end;

each of said first ends including:

a first portion;

a first anchor plate pivotally connected to said first portion;

a first plurality of swing bolts pivotally connected to said first anchor plate such that when said first plurality of swing bolts is unfastened, said link is permitted to pivot relative to said first anchor plate;

said second end of said link including:

a second portion;

a second anchor plate;

a second plurality of swing bolts pivotally connected to said second anchor plate such that said second plurality of swing bolts cooperate with corresponding closed channels defined by said second portion such that in said operative mode, said second plurality of swing bolts are tightened for rigidly connecting together said second portion and said second anchor plate and when the press apparatus is in said inoperative mode, said second plurality of swing bolts are unfastened and pivoted away from said second portion such that said link is permitted to pivot away from said press apparatus enabling the upward removal of said press members and backing roll means from the press apparatus and for facilitating the changing of press felts.

* * * * *

UNITED STATES PATENT AND TRADEMARK OFFICE

CERTIFICATE OF CORRECTION

PATENT NO. : 4,949,634

DATED : August 21, 1990

INVENTOR(S) : Ian W. Riddick

It is certified that error appears in the above—identified patent and that said Letters Patent is hereby corrected as shown below:

| | |
|---|---|
| Column 1, Line 38: | Delete "means" and insert therefor --mass-- |
| Column 2, Line 37: | Delete "for" and insert therefor --from-- |
| Column 5, Line 45: | Delete "ink" and insert therefor --link-- |
| Column 12, Line 32: | Please insert --,-- after "support means" |

Signed and Sealed this

Fourteenth Day of January, 1992

*Attest:*

HARRY F. MANBECK, JR.

*Attesting Officer*

*Commissioner of Patents and Trademarks*